US005413130A

United States Patent [19]

Maruyama et al.

[11] Patent Number: 5,413,130

[45] Date of Patent: May 9, 1995

[54] DISHWASHING MACHINE

[75] Inventors: Fumio Maruyama, Nagoya; Tomio Suyama, Shimane, both of Japan

[73] Assignee: Hoshizaki Denki Kabushiki Kaisha, Aichi, Japan

[21] Appl. No.: 128,040

[22] Filed: Sep. 29, 1993

[51] Int. Cl.[6] ..... A47L 15/16

[52] U.S. Cl. ..... 134/95.3; 134/177; 134/199; 134/200

[58] Field of Search ..... 134/143, 175, 177, 199, 134/200, 95.3

[56] References Cited

U.S. PATENT DOCUMENTS

| | | | |
|---|---|---|---|
| 1,680,962 | 8/1928 | Voshardt | 134/200 X |
| 2,605,776 | 8/1952 | Lyman | 134/200 X |
| 2,673,761 | 3/1954 | Karlstrom | 134/177 X |
| 2,771,895 | 11/1956 | Bond | 134/200 X |
| 2,782,792 | 2/1957 | Robson et al. | 134/200 X |
| 2,850,025 | 9/1958 | Bond | 134/177 |

*Primary Examiner*—Philip R. Coe
*Attorney, Agent, or Firm*—Fisher & Associates

[57] ABSTRACT

A dishwashing machine the washing tub of which is opened at the top and is provided at its bottom portion with lower nozzle arms 51, 52. An upper opening of the washing tub is closed or opened by a door 20 which is provided with a top plate 21 of semi-circular cross-section and rotatable in its semi-circular direction along a pair of side walls of the washing tub. An upper nozzle arm is provided inside of the top plate at the central portion thereof. A water supply passage is provided along an internal surface of the door to supply a portion of hot wash water or rinse water supplied to the lower nozzle arms to the upper nozzle arm. When the upper opening of the washing tub is opened, the door and upper nozzle arm are housed in a rear portion of said washing tub.

5 Claims, 7 Drawing Sheets

DISHWASHING MACHINE

BACKGROUND OF THE INVENTION

1. Field of the Invention

The present invention relates to a dishwashing machine the washing tub of which is opened at the top for entry or takeout of tableware and is provided at its upper portion with a wash nozzle arm.

2. Description of the Prior Art

Such a dishwashing machine as described above is disclosed, for example, in Japanese Utility Model Laid-open Publications Nos. 1-128750 and 1-138257. In a dishwashing machine disclosed in Japanese Utility Model Laid-open Publication No. 1-128750, tile upper opening of the washing tub is closed by a door which is provided with a wash nozzle arm. Since the door is mounted at its rear end on a rear end of the upper opening to be opened upwardly, it is required to provide an upper space for upward movement of the door. As a result, the installment place of the dishwashing machine is limited. In addition, when the door is opened, a handle mounted on the front end of the door is positioned behind the door, resulting in difficulty of operation of the door.

In a dishwashing machine disclosed in Japanese Utility Model Laid-open Publication 1-138257, the upper opening of the washing tub is closed by a door in the form of a flexible shutter. Since a frictional resistance at the contact portion of the shutter with its guide rails is inevitably increased, smooth movement of the shutter may not be expected. Since in the prior art of the dishwashing machines, the upper wash nozzle arm is arranged at one side of the upper opening to permit entry of tableware, the washing extent of the upper wash nozzle arm is limited, and uniform washing of the tableware may not be effected.

SUMMARY OF THE INVENTION

It is, therefore, a primary object of the present invention to provide an improved dishwashing machine capable of overcoming the problems discussed above.

According to the present invention, the object is accomplished by providing a dishwashing machine having a washing tub which is opened at the top for entry of tableware and takeout of the tableware after washing and provided at its bottom portion with a lower nozzle arm for spraying jet streams of hot wash water or rinse water upwardly, wherein the dishwashing machine comprises a door having a top plate of semi-circular cross-section arranged to be rotatable in its semi-circular direction along a pair of side walls of the washing tub, the top plate being movable between a closed position where it is placed to close an upper opening of the washing tub and an open position where it is housed in a rear portion of the washing tub, an upper nozzle arm provided inside of the top plate to be movable with the top plate, the upper nozzle arm being arranged at a central portion of the top plate to spray jet streams of hot wash water or rinse water downwardly, and a water supply passage provided along an internal surface of said top plate for supplying a portion of the hot wash water or rinse water supplied to the lower nozzle arm to the upper nozzle arm.

In the dishwashing machine, it is preferable that the door has a pair of side plates extended radially inwardly from both side edges of the top plate and pivoted to side walls of the washing tub so that the door is rotatable in a fore-and-aft direction of the washing tub, wherein a handle is mounted on a front portion of the top plate.

BRIEF DESCRIPTION OF THE DRAWINGS

Other objects, features and advantages of the present invention will be readily understood from the following detailed description of preferred embodiments thereof when referred to the accompanying drawings, in which.

DESCRIPTION OF THE PREFERRED EMBODIMENTS

Figure 1:
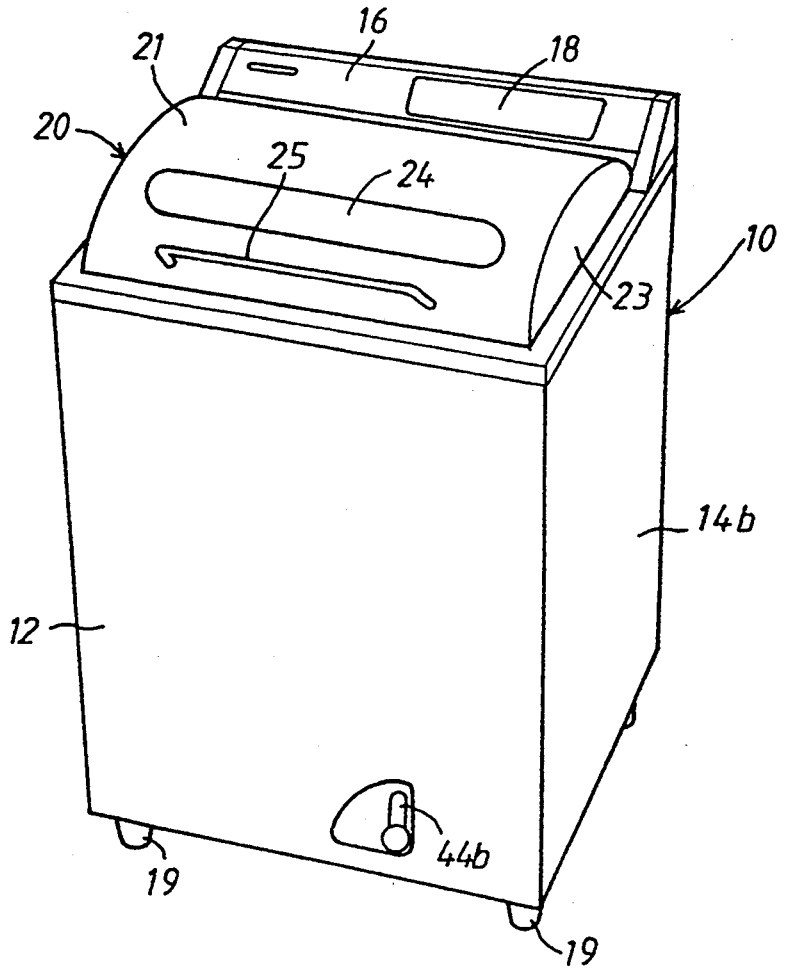
FIG. 1 is an entire perspective view of a dishwashing machine according to the present invention in a condition where a door of the dishwashing machine is closed.
Figure 2:
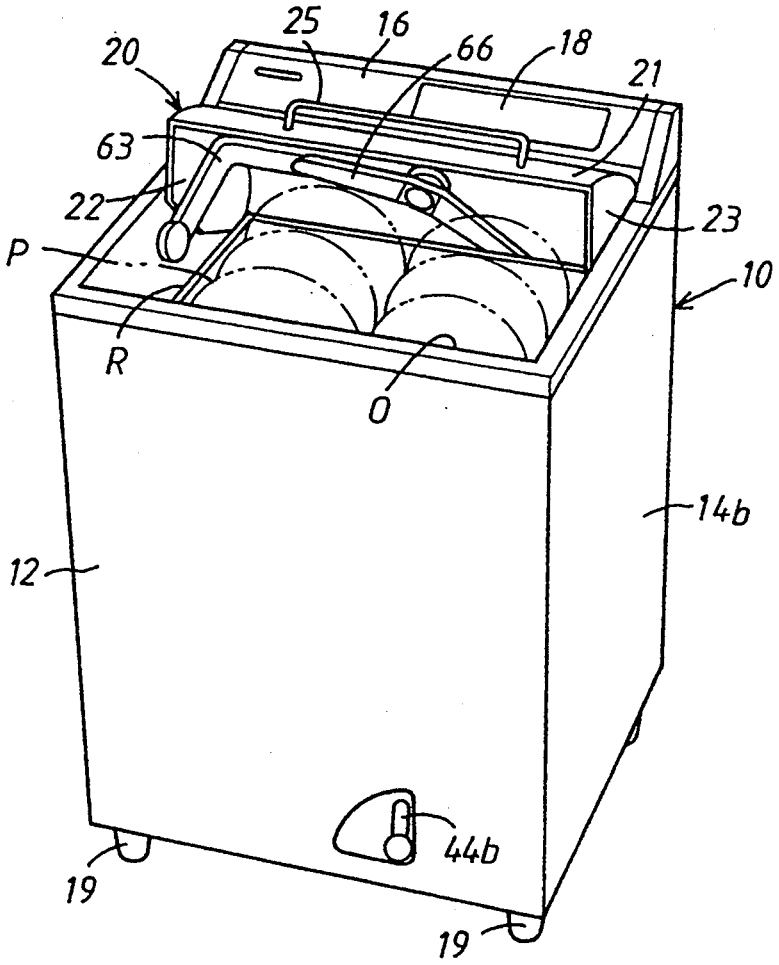
FIG. 2 is an entire perspective view of the dishwashing machine in a condition where the door is opened.
Figure 3:
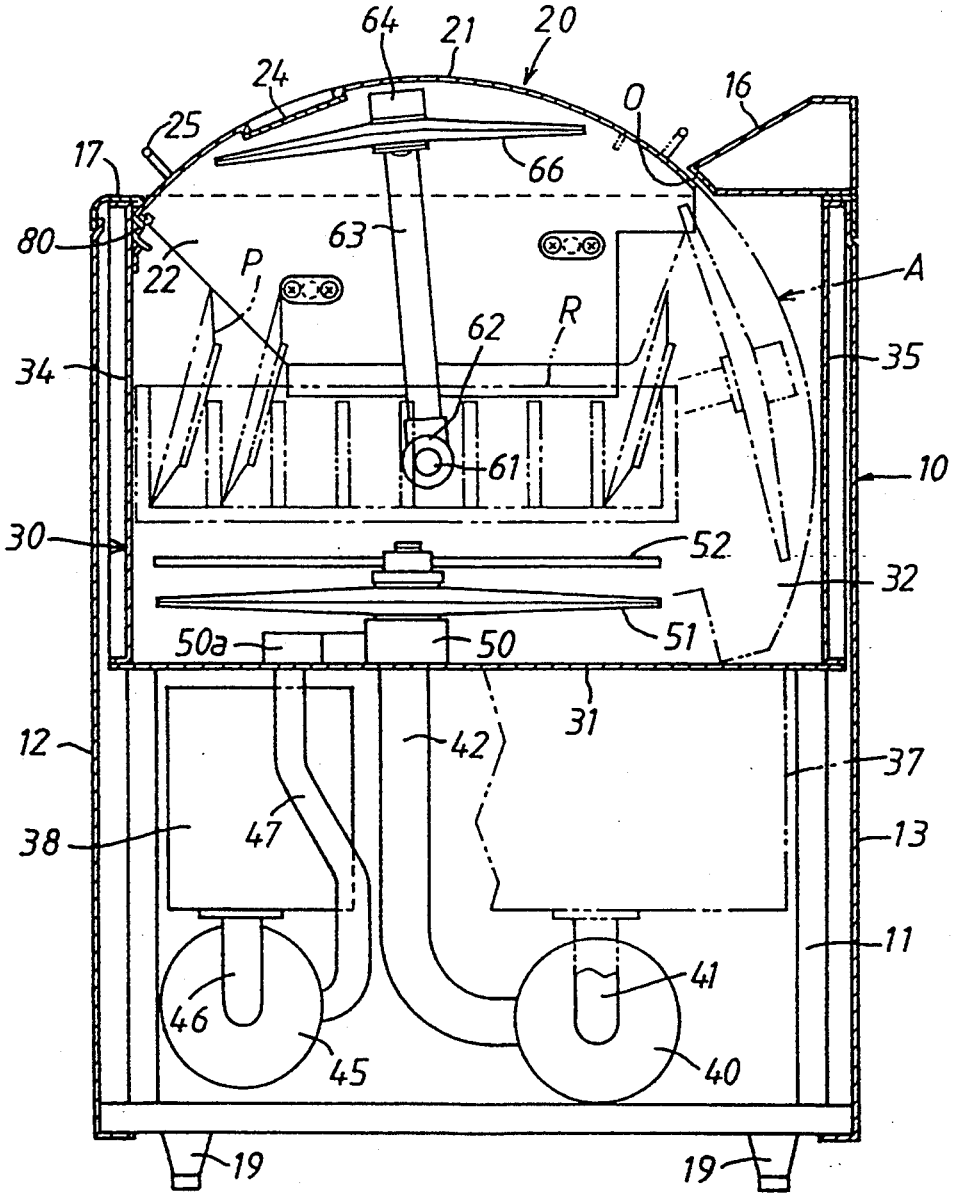
FIG. 3 is a sectional side view of the dishwashing machine shown in FIG. 1.
Figure 4:
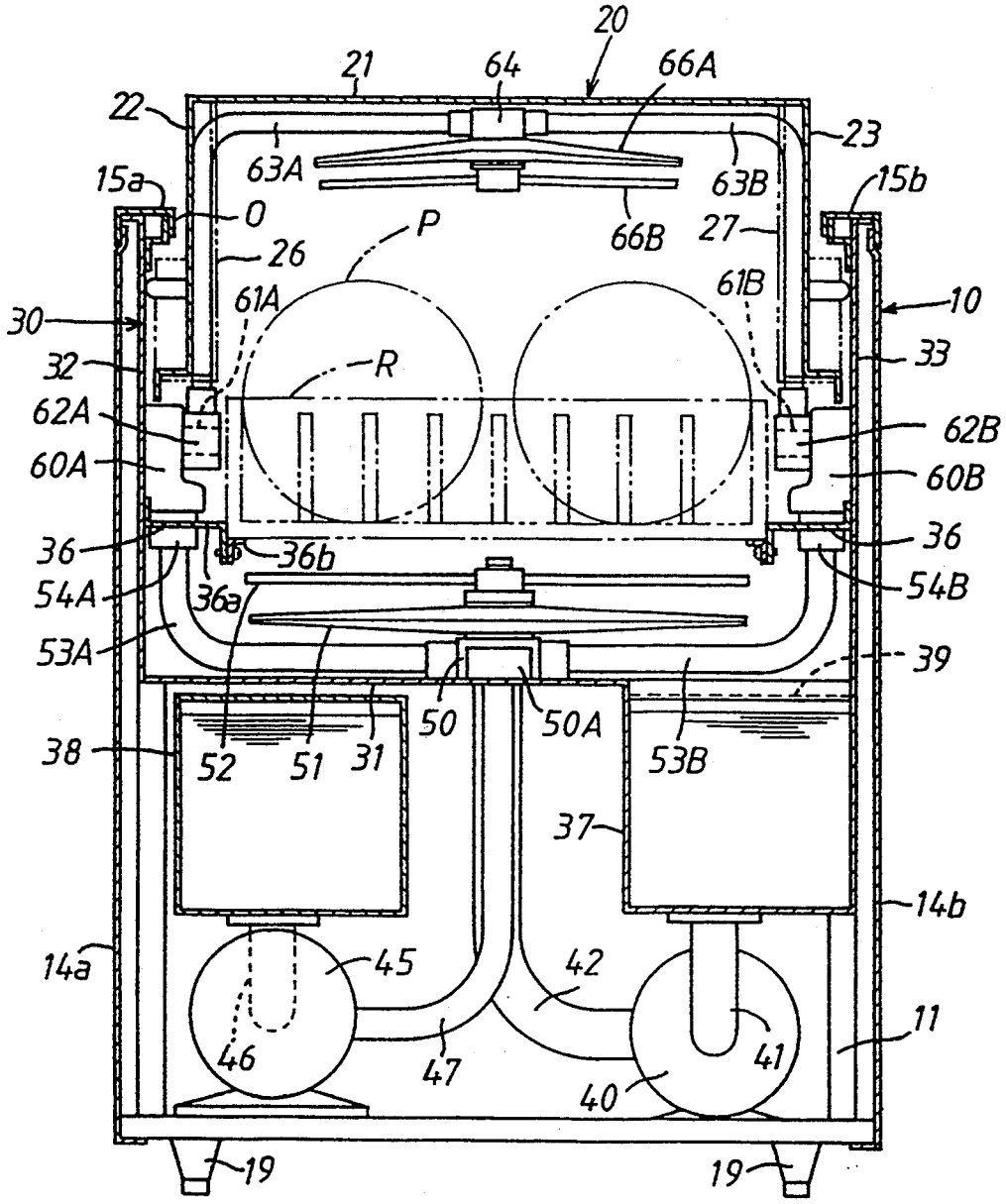
FIG. 4 is a sectional front view of the dishwashing machine shown in FIG. 1.

In FIGS. 1 and 2, there is illustrated a dishwashing machine 10 in the form of a square cabinet which has an upper opening 0 provided with a door assembly 20. As shown in FIGS. 3 and 4, a washing tub 30 is mounted on a frame structure 11 of the dishwashing machine 10. The frame structure 11 and washing tub 30 are enclosed by front and rear plates 12 and 13 and a pair of side plates 14*a*, 14*b*. The washing tub 30 is opened at the top and formed by a bottom wall 31, side walls 32, 33 and front and rear walls 34, 35 which are made of sheet metal and integrally combined in a liquid-tight manner. Provided at one side of the washing tub 30 is a wash tank 37 which is integrally formed with the bottom wall 31 and side wall 33 of washing tub 30. The front and rear plates 12, 13 and side plates 14*a*, 14*b* are connected at their upper edges to respective upper edges of the walls 32, 33, 34, 35 of the washing tub 30 and covered with front and rear opening frames 17, 16 and side opening frames 15*a*, 15*b* which form the upper opening 0. Mounted on the rear opening frame 16 is an operation panel 18 which is provided thereon with switches, a timer and a pilot lamp. As shown in FIG. 4, a pair of support rails 36 are secured to the side walls 32, 33 of washing tub 30 to receive thereon a dishrack R for containing tableware P. The support rails 36 each are composed of a support member 36*a* and a fall portion 36*b*.

As shown in FIGS. 1 to 4, the door assembly 20 is made of sheet metal and is composed of a top plate 21 of semi-circular cross-section extending along the side walls 32,33 of washing tub 30 at its side edges and a pair of side plates 22, 23 extending radially inwardly from the side edges of top plate 21. A pipe arm 63 secured to an internal surface of the left-hand side plate 22 is provided at its base end with a boss portion 62 which is pivoted to a cylindrical portion 61 of a hollow bracket 60 fixed to the left-hand side wall 32. On the other hand, an arm member 70 secured to an internal surface of the right-hand side plate 23 is fixed at its base end to a support shaft 72 which is rotatably supported by a bearing member 71 secured to the right-hand side wall 33. Each central axis of the cylindrical portion 61 and support shaft 72 is positioned to coincide with the rotary center of top plate 21 so that the door assembly 20 is rotatable in the semi-circular direction of the top plate 21. In a condition where the door assembly 20 has been rotated counterclockwlsely as shown by solid lines in FIG. 3, the front end of top plate 21 is maintained in engagement with a sealing member 80 secured to the front wall 34 to close the upper opening 0 of washing tub 30. When the door assembly 20 is rotated clockwisely as shown by imaginary lines in FIG. 3, the rear end of top plate 21 is engaged with the bottom plate 31 of washing tub 30 to fully open the upper opening 0 of washing tub 30. The top plate 21 has a handle 25 secured thereto in parallel with its front edge and a window glass 24 attached thereto at a rear portion of handle 25 for seeing the interior of washing tub 30. As shown in FIG. 4, the pipe arm 63 and arm member 70 are covered with cover plates 26, 27 which are secured to the side plates 22, 23.

As shown in FIGS. 3 and 4, lower wash and rinse nozzle arms 51 and 52 are rotatably mounted on a lower nozzle pedestal 50 fixed to the central portion of bottom plate 31 of washing tub 30. Separately from the wash tank 37, a rinse tank 38 is arranged below the bottom plate 31 of washing tub 30 within the dishwashing machine 10. A wash pump 40 is arranged within a lower portion of the dishwashing machine 10 to pump up hot wash water from the wash tank 37 through an induction conduit 41 and supply it to the lower nozzle pedestal 50 through a discharge conduit 42. A rinse pump 45 is arranged below the rinse tank 38 to pump up hot rinse water from the rinse tank 38 through an induction conduit 46 and supply it to an extended portion 50*a* of the lower nozzle pedestal 50 through a discharge conduit 47. The interior of lower nozzle pedestal 50 is subdivided into inside and outside spaces (not shown). The hot wash water from conduit 42 is supplied into the lower wash nozzle arm 51 through the outside space of lower nozzle pedestal 50, while the hot rinse water from conduit 47 is supplied into the lower rinse nozzle arm 52 through the extended portion 50*a* and inside space of lower nozzle pedestal 50. The lower wash and rinse nozzle arms 51, 52 each are formed at their wing portions with a number of nozzle holes which are opened upwardly in a direction perpendicular to a radial direction across the center of lower nozzle pedestal 50. When supplied with the hot wash water, the wash nozzle arm 51 is rotated by jet reaction of the hot wash water and sprays jet streams of the hot wash water upwardly. When supplied with the hot rinse water, the rinse arm 52 is rotated by jet reaction of the hot rinse water and sprays jet streams of the hot rinse water upwardly. As shown in FIG. 4, a scrap filter 39 is provided between the washing tub 30 and the wash tank 37 to receive food scraps released from the tableware P in washing operation.

Figure 5:
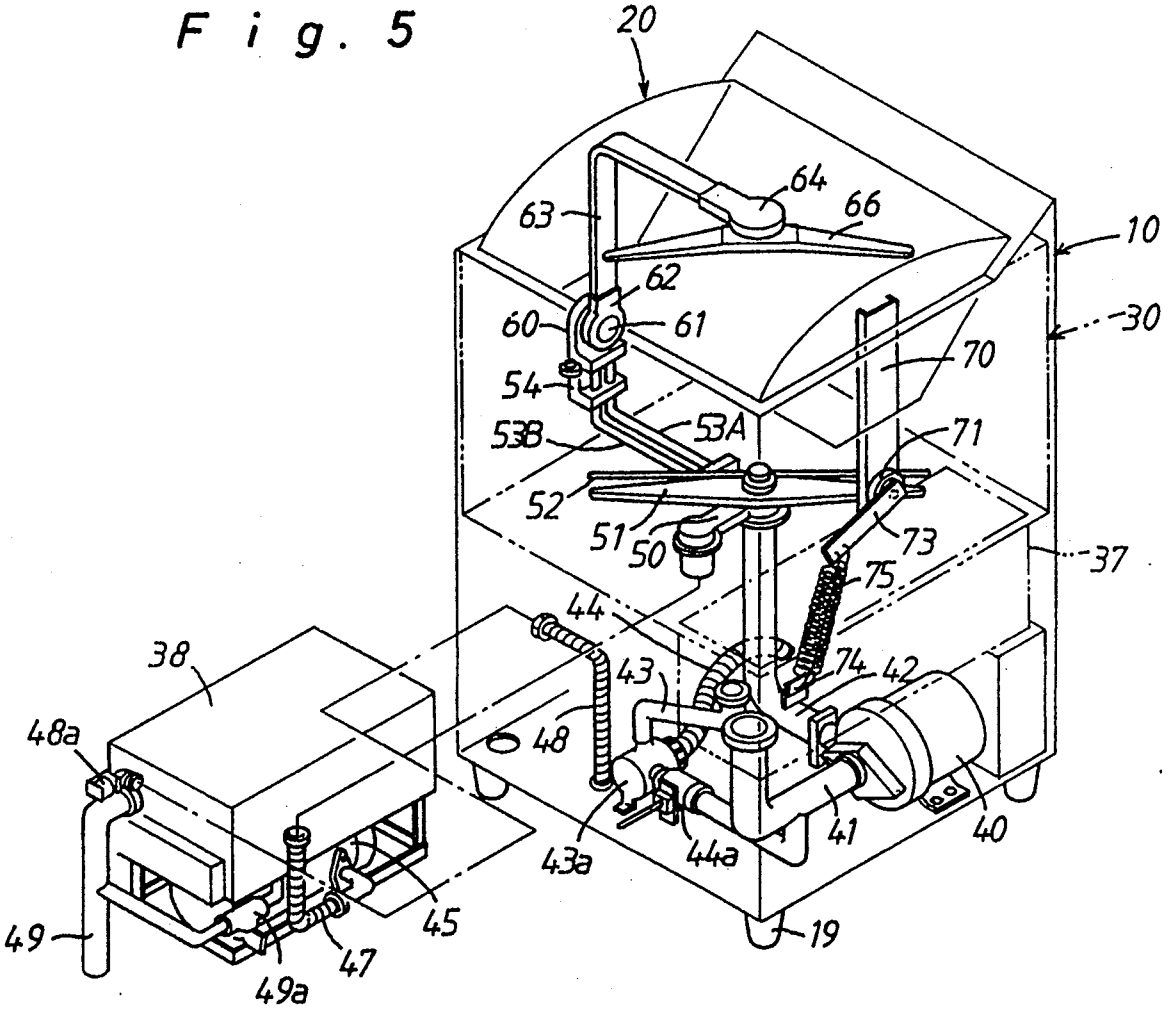
FIG. 5 is a view illustrating internal mechanisms of the dishwashing machine shown in FIG. 1.

As mainly shown in FIG. 5, an overflow pipe 43 is extended upwardly into the wash tank 37 and connected at its lower end to a drain pipe 44 by means of a three-way branch joint 43*a*. The induction conduit 41 is connected at its lower end to the three-way branch joint 43*a* through a drain cock 44*a* which is arranged to be operated by a drain lever 44*b* shown in FIGS. 1 and 2. The rinse tank 38 is connected at its upper portion to a water supply pipe 48 through a water valve 48*a*. An overflow pipe 49 is connected to the rinse tank 38 at a position slightly lower than the water valve 48*a* and is connected at its intermediate portion to the bottom portion of rinse tank 38 through a drain cock 49*a*.

Figure 6:
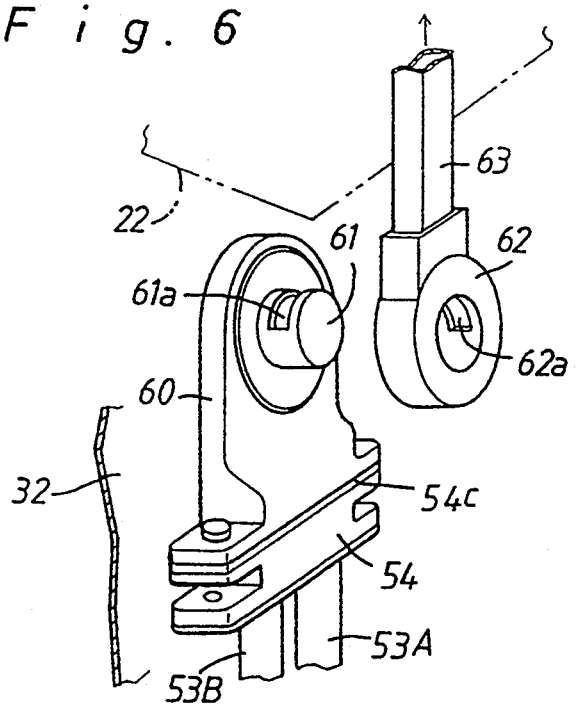
FIG. 6 is a perspective view of a left-hand pivot portion of the door shown in FIG. 1.

As shown in FIGS. 4 to 6, the hollow bracket 60 is fixed to an internal surface of the left-hand side wall 32 and is integrally formed with the cylindrical portion 61 which is formed at its peripheral wall with a water supply hole 61*a* as shown in FIG. 6 and communicated with the interior of bracket 60. A connecting bracket 54 is mounted to the bottom portion of hollow bracket 60 through a gasket 54*c* and is connected to the lower nozzle pedestal 50 by means of a pair of water supply conduits 53A and 53B. The water supply conduit 53A is arranged to communicate the interior of hollow bracket 60 with the outside space of lower nozzle pedestal 50 through a cheek valve contained in the connecting bracket 54. The water supply conduit 53B is arranged to communicate the interior of hollow bracket 60 with the inside space of lower nozzle pedestal 50 through another check valve contained in the connecting bracket 54. With this arrangement, the hot wash water and rinse water are selectively supplied into the hollow bracket 60 from the lower nozzle pedestal 50. In addition, the rail portion 36*b* of support rail 36 is extended in the entire length of the dishrack R, while the support member 36*a* is recessed at a position corresponding with the hollow bracket 60.

The boss portion 62 of pipe arm 63 is formed with a bore rotatably coupled with the cylindrical portion 61 of hollow bracket 60 in a liquid-tight manner. The bore of boss portion 62 is formed at its peripheral wall with a water supply hole 62*a* in open communication with the interior of pipe arm 63 and arranged to be fully communicated with the water supply hole 61*a* in a condition where the door 20 has been closed. The pipe arm 63 has a radially extended portion fixed to the left-hand side plate 22 and a lateral portion extended along an internal surface of the top plate 21. An upper nozzle pedestal 64 is connected to the upper end of pipe arm 63 at the central portion of top plate 21, and an upper wash nozzle arm 66 is rotatably mounted on the nozzle pedestal 64. Thus, a water supply passage for supplying a portion of hot wash water or rinse water from the lower nozzle pedestal 50 to the upper nozzle arm 66 is composed of the water supply conduits 53A, 53B, connecting bracket 54, hollow bracket 60, cylindrical portion 61, boss portion 62 and pipe arm 63. The upper wash nozzle arm 66 is formed at its wing portions with a number of nozzle holes which are opened downwardly in a direction perpendicular to a radial direction across the center of upper nozzle pedestal 64. When supplied with the hot wash or rinse water, the wash nozzle arm 66 is rotated by jet reaction of the hot wash water or rinse water and sprays jet streams of the hot wash water or rinse water downwardly.

Figure 7:
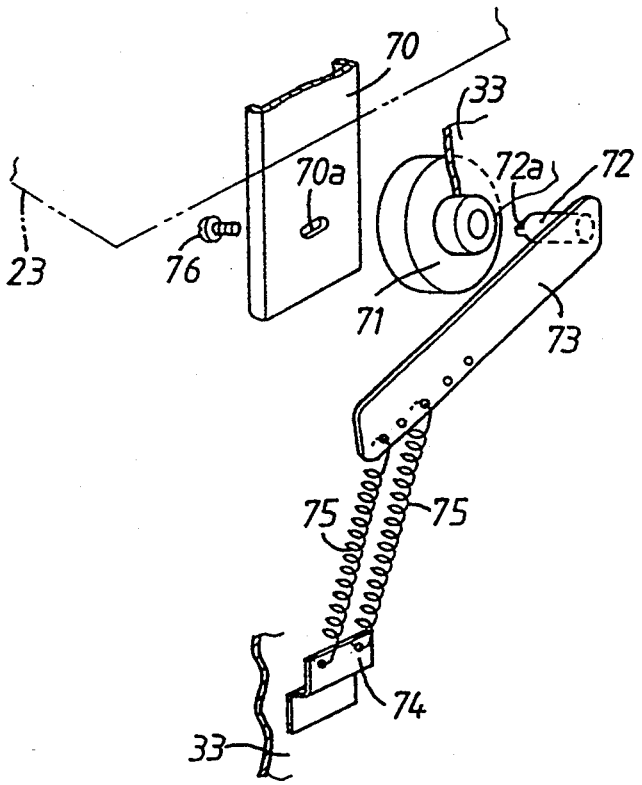
FIG. 7 is a perspective view of a right-hand pivot portion of the door shown in FIG. 1.

As shown in FIGS. 4 and 7, the bearing member 71 is fixed to an internal surface of the right-hand side wall 33 coaxially with the cylindrical portion 61 of hollow bracket 60. The arm member 70 fixed to the right-hand side plate 23 of the door assembly 20 is formed at its base end portion with an elongated hole 70*a* which is fixedly coupled with a chamfered end of the support shaft 72. The base end of arm member 70 is fixed to the chamfered end of support shaft 71 by means of a fastening screw 76. The support shaft 72 is secured to a lever 73 by welding and is rotatably supported by the bearing member 71. Two coil springs 75, 75 are connected at their one ends with the lever 73 and at their other ends with a retainer 74 fixed to an external surface of the right-hand side wall 33 to reduce an operation force of the door assembly 20 in accordance with movement of the center of gravity of door assembly 20.

In operation of the dishwashing machine, the rinse tank 38 is supplied with hot water from an external supply source of hot water through the water supply conduit 48 and water valve 48*a*, and the rinse pump 45 is activated to supply the hot water from the rinse tank 38 to the lower and upper nozzle arms 52 and 66. Thus, the nozzle arms 52 and 66 rotate to spray jet streams of the hot rinse water toward the interior of washing tub 30. The sprayed hot water is stored in the wash tank 37, and the preparation for washing is finished when the level of hot water in wash tank 37 becomes higher than a predetermined level. During operation of the rinse pump 45, an appropriate amount of detergent is put into the washing tub 30. Subsequently, soiled tableware P contained in the dishrack R is inserted into the washing tub 30, and the door 20 is closed. Thereafter, the wash pump 40 is activated to supply the hot water from the wash tank 37 to the lower and upper wash nozzle arms 51 and 66. Thus, the wash nozzle arms 51, 66 rotate to spray jet streams of the hot water over the racked tableware P for washing thereof. After sprayed, the hot wash water is circulated into the wash tank 37 and is pumped up by the wash pump 40 to repeat the washing operation. In this instance, the rinse nozzle arm 52 is maintained in an inoperative condition, and the hot water from the lower nozzle pedestal 50 is supplied to the upper nozzle pedestal 64 only through the water supply conduit 53A without passing through the water supply conduit 53B. Food scraps released from the tableware are received by the scrap filter 39 and retained thereon without being sucked into the wash pump 40.

When the washing operation is finished, the wash pump 40 is deactivated, and the rinse pump 45 is activated to supply fresh hot rinse water to the lower and upper nozzle pedestals 50 and 64 from the rinse tank 38. Thus, the lower and upper nozzle arms 52, 66 rotate to spray jet streams of the hot rinse water over the racked tableware P. After sprayed, the hot rinse water is circulated into the wash tank 37 and discharged outwardly from the overflow pipe 43 and drain pipe 44 when the level of water in wash tank 37 exceeds a predetermined level. In this instance, the hot rinse water from the lower nozzle pedestal 50 is supplied to the upper nozzle pedestal 64 only through the water supply conduit 53B without passing through the water supply conduit 53A, and the wash nozzle arm 51 is maintained in an inoperative condition. When the rinsing operation is finished, the rinse pump 45 is deactivated, and the hot water remained in the wash tank 37 is used in the following washing operation. If the drain lever 44*b* located at the front of dishwashing machine 10 is operated to open the drain cock 44*a*, the hot water is discharged from the wash tank 37 through the branch joint 43*a* and drain pipe 44.

In this embodiment, when the handle 25 has been operated to rotate the door 20 rearwardly, the door 20 and upper nozzle arm 66 are housed in a rear portion of the washing tub 30. Thus, the upper opening 0 of the dishwashing machine 10 is fully opened to facilitate entry of the racked tableware P into the washing tub 30 or takeout of the racked tableware P from the washing tub 30. When the door 20 is rotated about the cylindrical portion 61 and support shaft 72, the pipe arm 63 is maintained in open communication with the hollow bracket 60 through the cylindrical portion 61. Thus, the door 20 can be smoothly opened or closed without any disturbance caused by the water supply passage to the upper wash nozzle arm 66. Since the support portion of the door 20 is constructed as a portion of the water supply passage to the upper nozzle arm 66, the water supply conduits can be housed in a simple construction within the dishwashing machine 10, and the appearance of the dishwashing machine 10 can be shapely formed. Since the door 20 does not protrude upwardly when it has been opened, the dishwashing machine 10 can be installed at a selected place, and the upper space of the dishwashing machine 10 can be effectively utilized. Furthermore, the door 20 can be easily closed since the handle 25 is not concealed when the door 20 has been opened.

Figure 8:
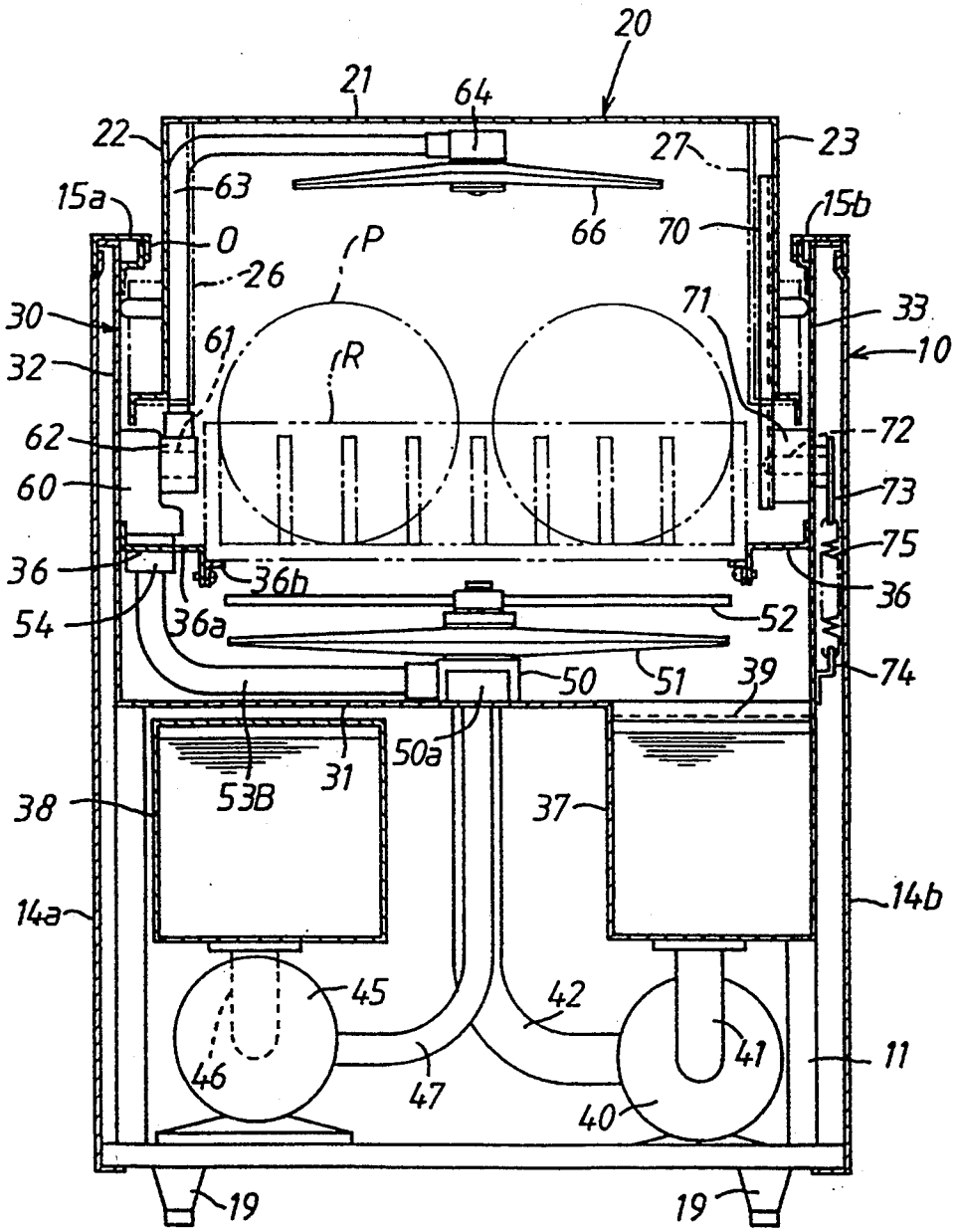
FIG. 8 is a sectional front view of another embodiment of the present invention.

In FIG. 8 there is illustrated another embodiment of the present invention, wherein the water supply conduits 53A, 53B connecting the lower nozzle pedestal 50 to the upper nozzle pedestal 64 are separated for supplying hot wash water and hot rinse water and arranged at the both sides of the washing tub 30. Fixed to the side walls 32, 33 of washing tub 30 are a pair of hollow brackets 60A, 60B which are substantially the same in construction as the hollow bracket 60 of the above embodiment. The hollow brackets 60A, 60B are communicated with the outside and inside spaces of the lower nozzle pedestal 50 through the water supply conduits 53A, 53B and connecting brackets 54A, 54B, respectively. The interior of upper nozzle pedestal 64 is subdivided into inside and outside spaces, and upper wash and rinse nozzle arms 66A, 66B are rotatably mounted on a lower portion of the nozzle pedestal 64. The upper wash nozzle arm 66A is arranged to be supplied with hot wash water from the outside space of the nozzle pedestal 64, while the upper rinse nozzle arm 66B is arranged to be supplied with hot rinse water from the inside space of the nozzle pedestal 64. Pipe arms 63A, 63B rotatably coupled at their boss portions 62A, 62B with respective cylindrical portions 61A, 61B of the hollow brackets 60A, 60B are the same in construction as the pipe arm 63 of the above embodiment and are arranged to communicate the interiors of hollow brackets 60A, 60B with the outside and inside spaces of the upper nozzle pedestal 64. Since other construction and parts of this embodiment are substantially the same as those of the above embodiment, further description is abbreviated.

In washing operation, the wash pump 40 is activated to supply hot wash water from the wash tank 37 to the lower wash nozzle arm 51 and to supply the hot wash water to the upper wash nozzle arm 66A through a first supply passage including the water supply conduit 53A, hollow bracket 60A and pipe arm 63A. Thus, the lower and upper wash nozzle arms 51 and 66A rotate to spray jet streams of the hot wash water over the racked tableware P. In this instance, the hot wash water does not flow into a second supply passage including the water supply conduit 53B, hollow bracket 60B and pipe arm 63B, and the lower and upper rinse nozzle arms 52 and 66B are maintained in an inoperative condition.

In rinsing operation, the rinse pump 45 is activated to supply hot rinse water from the rinse tank 38 to the lower rinse nozzle arm 52 and to supply the hot rinse water to the upper rinse nozzle arm 66B through the second supply passage. Thus, the lower and upper rinse nozzle arms 52 and 66B rotate to spray jet streams of the hot rinse water over the racked tableware P for rinsing. In this instance, the hot rinse water does not flow into the first supply passage, and the lower and upper wash nozzle arms 51 and 66A are maintained in an inoperative condition.

Other operation and function of the dishwashing machine such as function of the door 20 are substantially the vsame as those in the above embodiment. In this embodiment, the upper nozzle arms 66A, 66B may be replaced with the single nozzle arm 66 for spraying both the hot wash water and hot rinse water as in the above embodiment. Although in the above embodiments the top plate 21 has been formed in a semi-circular cross-section, the sectional shape of the top plate may be formed in a multiangular cross-section.

What is claimed is:

1. A dishwashing machine having a washing tub, said tub having a bottom portion, at least a pair of opposed side walls, and a top which is opened for entry of tableware and removal of said tableware after washing, and said dishwashing machine being provided at said bottom portion with a lower nozzle arm for spraying jet streams of hot wash water or rinse water upwardly; said dishwashing machine comprising:

an unsegmented door comprising a top plate of semi-circular cross-section arranged to be rotatable in its semi-circular direction along said pair of opposed side walls of said washing tub, said top plate being movable between a closed position where said top plate is placed to close an upper opening of said washing tub and an open position where said top plate is housed in a rear portion of wash washing tub;

an upper nozzle arm provided inside of said top plate to be movable with said top plate, said upper nozzle arm being arranged at a central portion of said top plate to spray said jet streams of hot wash water or rinse water downwardly into said washing tub; and a water supply passage provided along an internal surface of said top plate for supplying a portion of said hot wash water or rinse water supplied to said lower nozzle arm to said upper nozzle arm.

2. The dishwashing machine recited in claim 1, further comprising:

a pair of side plate affixed to said top plate at respective side edges of said top plate, said pair of side plates extending radially inwardly from said respective side edges of said top plate, and said side plates pivotally attached to said pair of opposed side walls of said washing tub so that said door is rotatable in a fore-and-aft direction of said washing tub; and a handle mounted on a front portion of said top plate.

3. A dishwashing machine having a washing tub, said tub having a bottom portion, at least a pair of opposed side walls, and a top which is opened for entry of tableware and removal of said tableware after washing, and said dishwashing machine being provided at said bottom portion with a lower nozzle arm for spraying jet streams of hot wash water or rinse water upwardly within said washing tub; said dishwashing machine comprising:

a door comprising a top plate of semi-circular cross-section;

a pair of arm members secured to said door at respective opposed side edges thereof and extended radially inwardly from said side edges of said door, said arm members being pivoted to said pair of opposed side walls of said washing tub at a rotary center of said door, said door being movable between a closed position where said door is retained to close an upper opening of said washing tub and a open position where said door is housed in a rear portion of said washing tub;

an upper nozzle arm provided inside of said door to be movable with said door and arranged at a central portion of said door to spray said jet streams of hot wash water or rinse water downwardly into said washing tub; and a water supply passage for supplying a portion of said hot wash water or rinse water supplied to said lower nozzle arm to said upper nozzle arm, said water supply passage comprising one of said arm members, said comprised arm member having a pipe shape formed at a proximal end, said comprised arm member having a boss portion located at a rotary center of said door, and said comprised arm member connected at a distal end to said upper nozzle arm; a hollow bracket fixed to said washing tub; a hollow shaft integrally formed with said hollow bracket said hollow shaft for supporting said boss portion of said comprised arm member rotatably thereon and for allowing communication between said comprised arm member and an interior of said hollow bracket; and a water conduit, bifurciated from a water supply conduit, said water conduit for supplying hot wash water or rinse water to said lower nozzle arm and in fluid communication with said interior of said hollow bracket.

4. The dishwashing machine recited in claim 1 wherein said water supply passage comprises:

an arm member, said arm member having a pipe shape formed at a proximal end, said arm member having a boss portion located at a rotary center of said door, and said arm member connected at a distal end to said upper nozzle arm;

a hollow bracket fixed to said washing tub;

a hollow shaft integrally formed with said hollow bracket, said hollow shaft for supporting said boss portion of said arm member rotatably thereon and for allowing communication between said arm member and an interior of said hollow bracket; and a water conduit, bifurcated from a water supply conduit, said water conduit for supplying hot wash water or rinse water to said lower nozzle arm and in fluid communication with said interior of said hollow bracket.

5. A dishwashing machine having a washing tub, said tub having a bottom portion, at least a pair of opposed side walls, and a top which is opened for entry of tableware and removal of said tableware after washing, and said dishwashing machine being provided at said bottom portion with a lower nozzle arm for spraying jet streams of hot wash water or rinse water upwardly within said washing tub; said dishwashing machine comprising:

an unsegmented door comprising a top plate of semi-circular cross-section arranged to be rotatable in its semi-circular direction along said pair of opposed side walls of said washing tub, said top plate being movable between a closed position where said top plate is placed to close an upper opening of said washing tub and an open position where said top plate is housed in a rear portion of said washing tub;

an upper nozzle arm provided inside of said top plate to be movable with said top plate, said upper nozzle arm being arranged at a central portion of said top plate to spray said jet streams of hot wash water or rinse water downwardly into said washing tub; and a water supply passage provided along an internal surface of said top plate for supplying a portion of said hot wash water or rinse water supplied to said lower nozzle arm to said upper nozzle arm, said water supply passage comprising an arm member, said arm member having a pipe shape formed at a proximal end, said arm member having a boss portion located at a rotary center of said door, and said arm member connected at a distal end to said upper nozzle arm; a hollow bracket fixed to said washing tub; a hollow shaft integrally formed with said hollow bracket, said hollow shaft for supporting said boss portion of said arm member rotatably thereon and for allowing communication between said arm member and an interior of said hollow bracket; a first water conduit for supplying hot wash water; a second water conduit for supplying rinse water, said first and second water conduits for supplying said respective hot wash water and rinse water to said lower nozzle arm and both of said water conduits in fluid communication with said interior of said hollow bracket.

* * * * *